US010106349B2

(12) United States Patent
Mueller et al.

(10) Patent No.: US 10,106,349 B2
(45) Date of Patent: Oct. 23, 2018

(54) SHEET-TRANSPORTING ELEMENT WITH INTEGRATED BLOCKING SLIDER FOR SUCTION OPENINGS

(71) Applicant: HEIDELBERGER DRUCKMASCHINEN AG, Heidelberg (DE)

(72) Inventors: Andreas Mueller, Heidelberg (DE); Burkhard Wolf, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/801,808

(22) Filed: Nov. 2, 2017

(65) Prior Publication Data

US 2018/0118485 A1 May 3, 2018

(30) Foreign Application Priority Data

Nov. 2, 2016 (DE) ..... 10 2016 221 455

(51) Int. Cl.
*B65H 5/02* (2006.01)
*B65H 5/04* (2006.01)
(Continued)

(52) U.S. Cl.
CPC ..... *B65H 5/04* (2013.01); *B65H 5/08* (2013.01); *B65H 5/18* (2013.01); *B65H 5/222* (2013.01); *B65H 5/226* (2013.01); *B65H 11/00* (2013.01); *B65H 2403/511* (2013.01); *B65H 2406/31* (2013.01); *B65H 2406/331* (2013.01); *B65H 2406/332* (2013.01); *B65H 2801/03* (2013.01)

(58) Field of Classification Search
CPC ... B65H 5/00; B65H 5/04; B65H 5/08; B65H 5/085; B65H 5/18; B65H 5/22; B65H 5/222; B65H 5/36; B65H 11/00; B65H 11/005; B65H 2403/51; B65H 2403/511; B65H 2406/331; B65H 2406/3312; B65H 2406/3314; B65H 2406/332; B65H 2406/33; B65H 2406/36; B65H 2406/361; B65H 2406/3612; B65H 2406/3614; B65H 2406/362; B65H 2406/3622; B65H 2406/363; B65H 2406/3632
See application file for complete search history.

(56) References Cited

U.S. PATENT DOCUMENTS 5,133,543 A * 7/1992 Eitel ..... B65H 5/24 271/197
9,796,546 B1 * 10/2017 LeFevre ..... B65H 5/224
(Continued)

FOREIGN PATENT DOCUMENTS

DE 3024602 A1 1/1982
DE 19857745 A1 6/2000
(Continued)

*Primary Examiner* — Prasad V Gokhale
(74) *Attorney, Agent, or Firm* — Laurence A. Greenberg; Werner H. Stemer; Ralph E. Locher

(57) ABSTRACT

A sheet-transporting element includes suction openings for holding print sheets, longitudinal sliders including air passages, and transverse sliders including air passages. The longitudinal sliders and the transverse sliders are disposed in a cross-wise configuration and are movable into different positions corresponding to various sheet formats in the positions blocking selected ones of the suction openings.

9 Claims, 2 Drawing Sheets

(51) Int. Cl.

| | |
|---|---|
| ***B65H 5/22*** | (2006.01) |
| ***B65H 5/08*** | (2006.01) |
| ***B65H 5/18*** | (2006.01) |
| ***B65H 11/00*** | (2006.01) |

(56) References Cited

U.S. PATENT DOCUMENTS

| | | | | |
|---|---|---|---|---|
| 9,815,303 | B1 * | 11/2017 | Herrmann | B41J 2/01 |
| 2002/0110400 | A1 * | 8/2002 | Beehler | B41J 11/0025<br>400/635 |
| 2009/0284575 | A1 * | 11/2009 | Verhoest | B41J 11/001<br>347/104 |
| 2010/0314828 | A1 * | 12/2010 | Hoover | B65H 5/224<br>271/276 |
| 2012/0068401 | A1 * | 3/2012 | Kondo | B41J 13/226<br>271/18.1 |
| 2015/0259170 | A1 * | 9/2015 | Fauconneau | B41F 19/064<br>156/433 |

FOREIGN PATENT DOCUMENTS

| | | | |
|---|---|---|---|
| DE | 202010014946 | U1 | 2/2011 |
| DE | 102014215800 | A1 | 2/2016 |
| DE | 102015221822 | A1 | 6/2016 |
| GB | 2079260 | A | 1/1982 |

* cited by examiner

SHEET-TRANSPORTING ELEMENT WITH INTEGRATED BLOCKING SLIDER FOR SUCTION OPENINGS

CROSS-REFERENCE TO RELATED APPLICATION

This application claims the benefit, under 35 U.S.C. § 119, of German Patent Application DE 10 2016 221 455.1, filed Nov. 2, 2016; the prior application is herewith incorporated by reference in its entirety.

BACKGROUND OF THE INVENTION

Field of the Invention

The present invention relates to a sheet-transporting element including suction openings for holding print sheets.

German Patent Application DE 10 2015 221 822 A1 describes a sheet-transporting element that may be embodied as a drum or tray. In that sheet-transporting element, at least one sensor is assigned to every suction opening. The sensor is used to control the suction effect of the suction air applied by the suction opening.

German Patent Application DE 198 57 745 A1 describes a sheet-guiding device that does not move with the print sheets and is consequently not a sheet-transporting element.

SUMMARY OF THE INVENTION

It is accordingly an object of the invention to provide a sheet-transporting element with an integrated blocking slider for suction openings, which overcomes the hereinafore-mentioned disadvantages of the heretofore-known devices of this general type and which has a high degree of operational reliability.

With the foregoing and other objects in view there is provided, in accordance with the invention, a sheet-transporting element, comprising suction openings for holding print sheets, longitudinal sliders including air passages, and transverse sliders including air passages. The longitudinal sliders and the transverse sliders are disposed in a cross-wise configuration and are movable into switching positions corresponding to different sheet formats to block different ones of the suction openings.

The different sheet formats may be sheet formats of different sizes. In this case, the longitudinal sliders and the transverse sliders block different numbers of suction openings in the switching positions. For instance, they block more suction openings in a switching position for a small sheet format, than in a position for a large sheet format.

The different sheet formats may also be formats of different orientation, namely portrait and landscape formats, which have identical print sheet sizes. In this case the sliders may cover the same number of suction openings in the switching position for portrait format as in the switching position for landscape format. In this case, the positions differ from one another in terms of the differing grid patterns of passive i.e. blocked suction openings.

An advantage of the sheet-transporting element of the invention is that suction opening switching errors are reliably avoided.

Various further developments of the sheet-transporting element of the invention are possible.

In accordance with another development of the invention, a common, first actuating drive is provided for switching the longitudinal sliders. The first actuating drive may be embodied as a first handle, as a first tool fitting profile, or preferably as a first motor.

In accordance with a further development of the invention, the first actuating drive is connected to a first spindle drive on which a first longitudinal slider switch and a second longitudinal slider switch are supported for linear movement. In this case, a right-hand thread of the first spindle drive may be screwed into the first longitudinal slider switch and a left-hand thread of the first spindle drive may be screwed into the second longitudinal slider switch. Alternatively, an actuating drive having a spindle drive may be provided for the first longitudinal slider switch and another actuating drive having another spindle drive may be provided for the second longitudinal slider switch. In this case the two longitudinal slider switches would no longer have a common actuating drive and common spindle drive. Instead, they would have a respective actuating drive and a respective spindle drive of their own.

In accordance with an added development of the invention, the first longitudinal slider switch and the second longitudinal slider switch have switching cams that enter into switching contact with cam followers provided on the longitudinal sliders.

In accordance with an additional development of the invention, a common second actuating drive is provided for switching the transverse sliders. In this case the second actuating drive may be a second handle, as a second tool fitting profile, or preferably as a second motor.

In accordance with yet another development of the invention, the second actuating drive is connected to a second spindle drive for adjusting a transverse slider switch. This transverse slider switch may have a switching cam that enters into switching contact with cam followers provided on the transverse sliders.

In accordance with yet a further development of the invention, the sheet-transporting element is a tray and the transverse slider is supported for linear movement.

In accordance with a concomitant development, alternatively, the sheet-transporting element may be a drum and the transverse slider switch may be disposed to pivot.

If the air passages of the transverse sliders (transverse slider holes) and the air passages of the longitudinal sliders (longitudinal slider holes) are disposed in a corresponding way, it is also possible for selected ones of the suction openings not to be blocked and to remain open in one switching position so that the sheet-transporting element has multiple rectangular suction areas with active (unblocked) suction openings.

Instead of the symmetrical setting, an asymmetrical or off-center setting of the transverse sliders is conceivable, which would result in an off-center suction area.

Other features which are considered as characteristic for the invention are set forth in the appended claims.

Although the invention is illustrated and described herein as embodied in a sheet-transporting element with an integrated blocking slider for suction openings, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
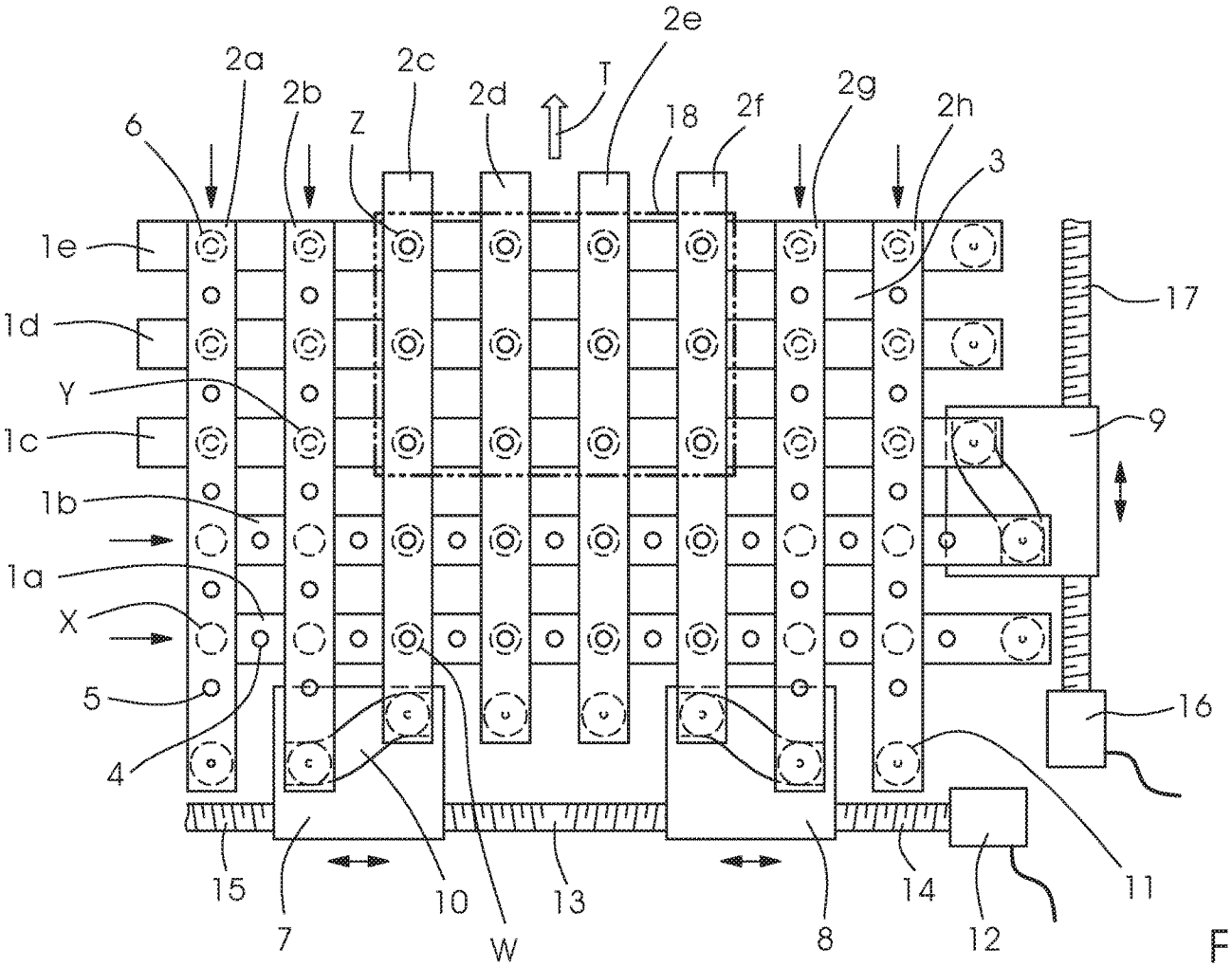
FIG. 1 is a fragmentary, diagrammatic, plan view of a sheet-transporting tray with an integrated blocking slider system for suction openings.

Referring now to the figures of the drawings in detail and first, particularly, to FIG. 1 thereof, there is seen a tray for an inkjet printing machine. The tray is a sheet-transporting element and may be referred to as such. It is transported through the printing machine together with a print sheet 18 resting thereon. The tray is shaped like a flat box having an interior space connectible to a vacuum source. The interior space forms a vacuum chamber having a vacuum chamber top 3. The drawing is a view of the inner side of the vacuum chamber top 3 from the interior space. The print sheet 18 rests on the outside of the vacuum chamber top 3.

The vacuum chamber top 3 is a metal plate. Its four side edges are not shown in the drawing. Top holes 6 forming suction openings are formed in the vacuum chamber top 3 in a square grid. The grid width is the same in the longitudinal direction, which corresponds to a direction of transport T of the tray and the print sheet 18, and in the transverse direction. The top holes 6 act to hold the print sheet 18 by suction.

The number of top holes 6 covered by the print sheet 18 varies from print job to print job in accordance with the sheet format. In order to prevent those top holes 6 that are not covered by the sheet 18 from drawing in air, these top holes 6 are sealed by a blocking slider system disposed in the vacuum chamber. The blocking slider system includes transverse sliders 1*a* to 1*e* and longitudinal sliders 2*a* to 2*h*, respectively disposed in a row. The transverse sliders 1*a* to 1*e* and the longitudinal sliders 2*a* to 2*h* are embodied as bars and are linearly guided by grooves or rails that are not shown in the drawing. These bars have a metal core coated with an elastic plastic. The coating improves the airtight properties of sliding surfaces of the bars.

The transverse sliders 1*a* to 1*e* are disposed in a different plane than the longitudinal sliders 2*a* to 2*h*. In the drawing, the longitudinal sliders 2*a* to 2*h* are shown above the transverse sliders 1*a* to 1*e*, which are located between the vacuum chamber top 3 and the longitudinal sliders 2*a* to 2*h*. An inverse configuration wherein the transverse sliders 1*a* to 1*e* are disposed above the longitudinal sliders 2*a* to 2*h* would likewise be possible. The transverse sliders 1*a* to 1*e* and the longitudinal sliders 2*a* to 2*h* are in a crosswise configuration.

The transverse sliders 1*a* to 1*e* are disposed to be movable relative to the vacuum chamber top 3 and relative to the longitudinal sliders 2*a* to 2*h* in a direction parallel to the direction of transport T. The longitudinal sliders 2*a* to 2*h* are disposed to be movable relative to the vacuum chamber top 3 and relative to the transverse sliders 1*a* to 1*e* in a direction orthogonal to the direction of transport T.

Every transverse slider 1*a* to 1*e* has a row of transverse slider holes 4 and every longitudinal slider 2*a* to 2*h* has a row of longitudinal slider holes 5. The transverse slider holes 4, longitudinal slider holes 5, and top holes 6 are through-holes. The hole distance between the transverse slider holes 4 and the hole distance between the longitudinal slider holes 5 correspond to the grid width of the top holes 6.

A first longitudinal slider switch 7 and a second longitudinal slider switch 8 are disposed to be movable towards and away from one another in a transverse direction. The two longitudinal slider switches 7, 8 act to displace the longitudinal sliders 2*a* to 2*h* into a pass position and a block position. In the pass position, the longitudinal sliders 2*a* to 2*h* allow suction air to pass through, whereas in the block position, the suction air is blocked. A transverse slider switch 9 acts to displace the transverse sliders 1*a* to 1*e* into a pass position and a block position. In the pass position, the transverse slider holes 4 or longitudinal slider holes 5 of the respective transverse slider 1*a* to 1*e* and the respective longitudinal slider 2*a* to 2*e* are aligned or flush with top holes 6, whereas in the block position, they are not aligned with the same top holes 6.

A section having a right-hand thread 15 is screwed into the first longitudinal slider switch 7 and a section having a left-hand thread 14 is screwed into the second longitudinal slider switch 8. The threads are part of a common first spindle drive 13. A first motor 12 rotates the first spindle drive 13 to move the two longitudinal slider switches 7, 8 in opposite directions relative to one another. A second spindle drive 17, which is rotated by a second motor 16, is screwed into the transverse slider switch 9 to move the transverse slider switch 9. The two motors 12, 16 are electric motors.

Each one of the two longitudinal slider switches 7, 8 and the transverse slider switch 9 has a respective switching cam 10. The switching cam is substantially S-shaped, including two parallel end sections connected by an intermediate section located between the two end sections of the cam profile. The two parallel end sections are disposed to be offset relative to one another in the direction of thrust of the sliders to be switched. This offset defines the switching distance between the two switching positions of the sliders as one half of the grid width of the top holes 6 and thus one half of the distance between the holes of the sliders.

In order to move the sliders, the switching cams 10 actuate cam followers 11 disposed at the ends of the sliders. The switching cams 10 are constructed as grooves and the cam followers 11 are constructed as rollers running in the grooves. When a respective switch is moved along the slider row, one cam follower 11 after another enters the switch, causing the sliders in the slider row to be switched one after another. The switching cams 10 of the two longitudinal slider switches 7, 8 extend in a mirror-symmetric way relative to one another.

The motors 12, 16 are actuated as a function of the respective format of the print sheet 18 to ensure that both the transverse slider holes 4 and the longitudinal slider holes 5 are aligned with the top holes 6 to allow suction air to pass through only in a vacuum chamber top 3 surface part that is covered by the print sheet 18. This alignment situation exists, for instance, in a grid position Z shown in the drawing. In this case the top hole 6 is aligned with a transverse slider hole 4 of the transverse slider 1*e* and simultaneously with a longitudinal slider hole 5 of the longitudinal slider 2*c*. Suction air may flow into the vacuum chamber through the three aligned holes 4, 5, 6 to hold the print sheet 18.

Every top hole 6 located within the surface part covered by the print sheet 18 is covered by two aligned slider holes, namely by a transverse slider hole 4 and a longitudinal slider hole 5. Every top hole 6 located outside the surface part covered by the print sheet 18 is either covered by only one slider hole or by no slider hole, in both cases preventing suction air from entering the vacuum chamber through the top hole 6.

In a grid position W, for instance, a top hole 6 is only covered by a longitudinal slider hole 5 of the longitudinal slider 2*c* but not by any transverse slider hole 4 of the transverse slider 1*a*. In a grid position X, a top hole 6 is aligned neither with a transverse slider hole 4 of transverse slider 1*a* nor with a longitudinal slider hole 5 of longitudinal slider 2*a*. In grid position Y, a top hole 6 is aligned only with a transverse slider hole 5 of the transverse slider 1*c* and not with any longitudinal slider hole 5 of the longitudinal slider 2*b*. Thus, in the grid positions X and Y, the top holes 6 are likewise covered by closed surface areas of the sliders, preventing air from being sucked into the vacuum chamber in an undesired way.

Figure 2:
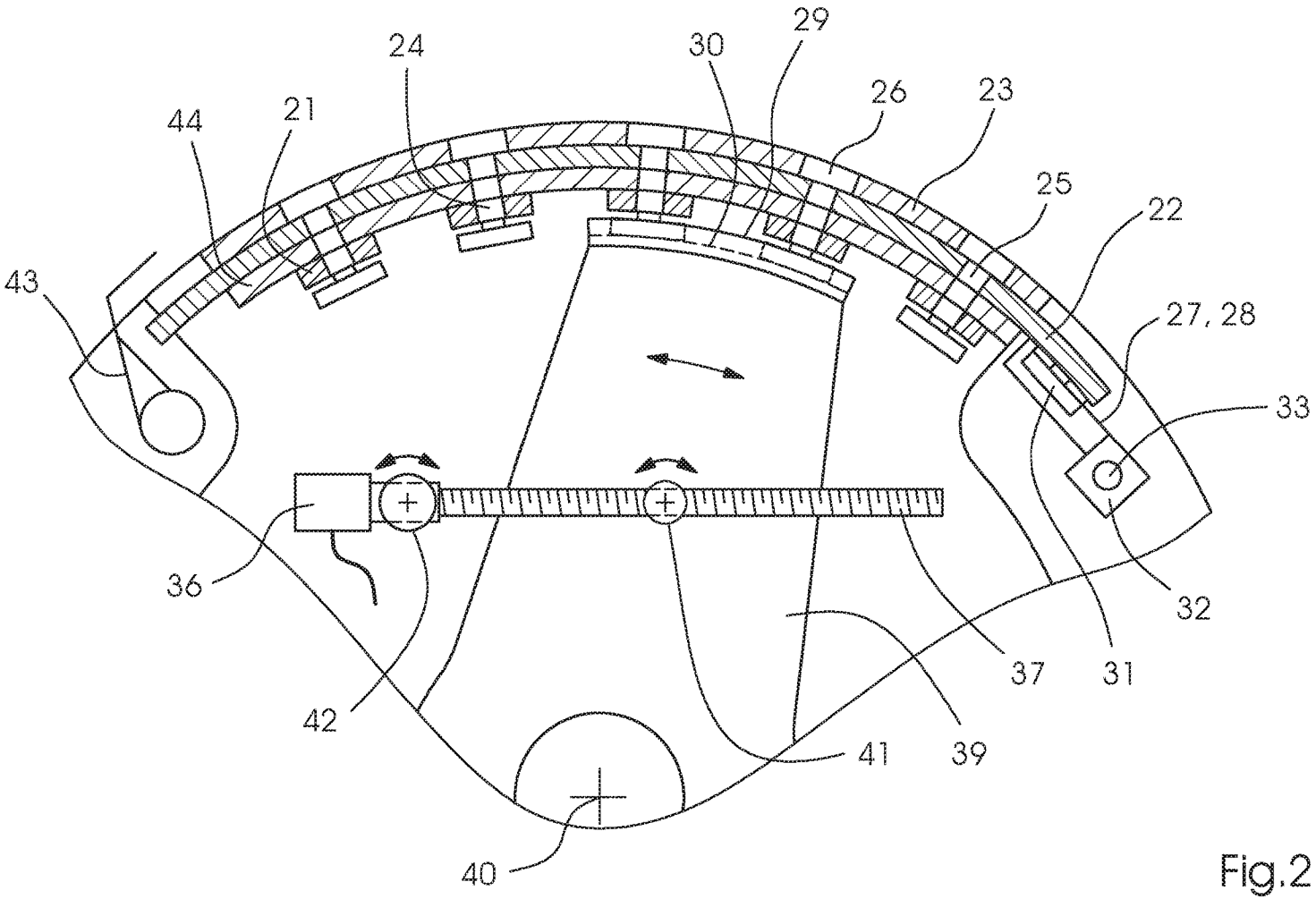
FIG. 2 is a fragmentary, cross-sectional view of a sheet-transporting drum with an integrated blocking slider system for suction openings.

FIG. 2 illustrates a drum in a printing machine for planographic offset printing or inkjet printing. The drum is a sheet-transporting element and may be referred to as such. A print sheet, which is not shown in FIG. 2, rests on a vacuum chamber top 23. The leading edge of the print sheet is held by clamping grippers 43. Top holes 26 disposed in a square grid in a manner similar to the tray in FIG. 1 are provided in the vacuum chamber top 23. The top holes 26 serve as suction openings. The vacuum chamber top 23 forms the peripheral or circumferential surface of the drum. The drum has an interior space connected to a vacuum source. The vacuum source generates a vacuum in the interior space, causing the print sheet to be held against the circumferential drum surface by using the top holes 26.

A blocking slider system including transverse sliders 21 and longitudinal sliders 22 is disposed in the interior space. The transverse sliders 21 are disposed in a row along the circumference of the drum and in such a way as to be movable in an axial direction parallel to the axis of rotation 40 of the drum. Due to this mobility the transverse sliders 21 may also be referred to as axial sliders. The longitudinal sliders 22 are disposed in a row parallel to the axis of rotation 40. Every longitudinal slider 22 is movable in a circumferential direction of the drum. Thus, the longitudinal sliders 22 may also be referred to as circumferential sliders.

An intermediate layer 44, which is disposed between the transverse sliders 21 and the longitudinal sliders 22, includes passages 45 that are aligned with the top holes 26 and disposed in a square grid. Such an intermediate layer would also be possible in the case of the tray shown in FIG. 1, but would be embodied as a flat plate and not as a curved shell as shown in FIG. 2.

Like the sliders of the tray shown in FIG. 1, the transverse sliders 21 and the longitudinal sliders 22 are provided with air passages, namely transverse slider holes 24 and longitudinal slider holes 25. A first longitudinal slider switch 27 and a second longitudinal slider switch 28 are screwed onto opposing thread sections of a first spindle drive 33. The first spindle drive 33, which has a construction corresponding to the construction shown in FIG. 1, is rotated by a first motor 32 to adjust the two longitudinal slider switches 27, 28 in opposite directions. A transverse slider switch 29 is disposed on a pivot lever 39 disposed to pivot about the axis of rotation 40.

The drum may be a single-size drum having only one sheet-supporting surface formed by the vacuum chamber top 23 and one cylinder gap including clamping grippers 43 located therein. In this case, the pivot lever 39 only has a single arm that supports the transverse slider switch 29.

However, the drum may also be a double-circumference cylinder including two sheet-supporting surfaces separated from one another by diametrical cylinder gaps. Clamping grippers are provided in every one of the two cylinder gaps. In this case the pivot lever includes two diametrical arms each of which carries a transverse slider switch. One of the transverse slider switches belongs to the blocking slider system of the one sheet-supporting surface and the other transverse slider switch belongs to the blocking slider system of the other sheet-supporting surface.

The drum may likewise be a triple-size drum having three sheet-supporting surfaces, with three transverse slider switches disposed on the three arms of a star-shaped pivot lever.

A quadruple-size drum having a cross-shaped pivot lever would also be possible.

In all cases only a single drive system that includes a second motor 36 for rotating a second spindle drive 37 is required for the pivot lever 39. The second motor 36 is supported in a base body of the drum by using a pivot pin 42. The second spindle drive 37, which is formed by an elongation of the motor shaft, is screwed into a spindle nut 41. The spindle nut 41 is articulated at an arm of the pivot lever 39. A rotation of the second motor 36 causes the spindle nut 41 to be screwed towards or away from the second motor 36 along the second spindle drive 37 as a function of the direction of rotation. This causes the pivot lever 39 to pivot and the transverse slider switch 29 disposed thereon to move into successive switching contact with one transverse slider 21 after another. When there is switching contact, a cam follower 31 disposed on the respective transverse slider 21 is actuated by a switching cam 30 of the transverse slider switch 29.

The two longitudinal slider switches 27, 28 have the same construction as the two longitudinal slider switches 7, 8 of the tray. The transverse slider switch 27 basically also has the same construction as the transverse slider switch 9 shown in FIG. 1 except for its curvature for the purpose of adaptation to the circumferential direction, the extending row of transverse sliders 21 and the cam followers 31 thereof.

The purpose and functioning of the blocking slider system of the drum correspond to those of the tray and therefore do not need to be described again.

Modifications of the tray and drum may include knobs or crank handles or fittings for a tool (e.g. hexagon profiles for a socket wrench) or similar actuating drives to provide structural measures for manually rotating the respective spindle drives 13, 17 and 33, 37 instead of respective motors 12, 16 and 32, 36.

The invention claimed is:

1. A sheet-transporting element, comprising:

suction openings for holding print sheets;

longitudinal sliders including first air passages;

transverse sliders including second air passages;

said longitudinal sliders and said transverse sliders being disposed in a crosswise configuration and being movable into switching positions corresponding to different sheet formats for blocking different ones of said suction openings;

a first actuating drive for switching said longitudinal sliders;

a first spindle drive connected to said first actuating drive; and a first longitudinal slider switch and a second longitudinal slider switch supported on said first spindle drive for linear movement;

said first spindle drive having a right-hand thread screwed into said first longitudinal slider switch and a left-hand thread screwed into said second longitudinal slider switch.

2. The sheet-transporting element according to claim 1, wherein said first actuating drive is a first motor.

3. The sheet-transporting element according to claim 1, which further comprises a second actuating drive for switching said transverse sliders.

4. The sheet-transporting element according to claim 3, wherein said second actuating drive is a second motor.

5. The sheet-transporting element according to claim 3, which further comprises:

a second spindle drive connected to said second actuating drive; and a transverse slider switch being adjusted by said second spindle drive.

6. The sheet-transporting element according to claim 5, wherein the sheet-transporting element is a tray and said transverse slider switch is configured for linear movement.

7. The sheet-transporting element according to claim 5, wherein the sheet-transporting element is a drum and said transverse slider switch is supported to pivot.

8. A sheet-transporting element, comprising:

suction openings for holding print sheets;

longitudinal sliders including first air passages;

transverse sliders including second air passages;

said longitudinal sliders and said transverse sliders being disposed in a crosswise configuration and being movable into switching positions corresponding to different sheet formats for blocking different ones of said suction openings;

a first actuating drive for switching said longitudinal sliders;

a first spindle drive connected to said first actuating drive;

a first longitudinal slider switch and a second longitudinal slider switch supported on said first spindle drive for linear movement; and cam followers disposed on said longitudinal sliders, said first longitudinal slider switch and said second longitudinal slider switch including switching cams entering into switching contact with said cam followers.

9. A sheet-transporting element, comprising:

suction openings for holding print sheets;

longitudinal sliders including first air passages;

transverse sliders including second air passages;

said longitudinal sliders and said transverse sliders being disposed in a crosswise configuration and being movable into switching positions corresponding to different sheet formats for blocking different ones of said suction openings;

an actuating drive for switching said transverse sliders;

a spindle drive connected to said actuating drive;

a transverse slider switch being adjusted by said spindle drive; and cam followers disposed on said transverse sliders, said transverse slider switch including a switching cam entering into switching contact with said cam followers.

* * * * *